US007899667B2

(12) United States Patent
Byun et al.

(10) Patent No.: US 7,899,667 B2
(45) Date of Patent: Mar. 1, 2011

(54) WAVEFORM INTERPOLATION SPEECH CODING APPARATUS AND METHOD FOR REDUCING COMPLEXITY THEREOF

(75) Inventors: Kyung-Jin Byun, Daejon (KR); Ik-Soo Eo, Daejon (KR); Hee-Bum Jung, Daejon (KR); Nak-Woong Eum, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 838 days.

(21) Appl. No.: 11/641,226

(22) Filed: Dec. 19, 2006

(65) Prior Publication Data

US 2008/0004867 A1 Jan. 3, 2008

(30) Foreign Application Priority Data

Jun. 19, 2006 (KR) ..... 10-2006-0055059
Aug. 25, 2006 (KR) ..... 10-2006-0081265

(51) Int. Cl.
*G10L 19/14* (2006.01)

(52) U.S. Cl. ..... 704/205; 704/207; 704/219; 704/222; 704/265

(58) Field of Classification Search ..... 704/205, 704/207, 218, 265
See application file for complete search history.

(56) References Cited

U.S. PATENT DOCUMENTS 5,517,595 A * 5/1996 Kleijn ..... 704/205
5,903,866 A * 5/1999 Shoham ..... 704/265
5,924,061 A 7/1999 Shoham
6,418,408 B1 * 7/2002 Udaya Bhaskar et al. .... 704/219
6,754,630 B2 * 6/2004 Das et al. ..... 704/268
6,801,887 B1 * 10/2004 Heikkinen et al. ..... 704/206
7,643,996 B1 * 1/2010 Gottesman ..... 704/265

FOREIGN PATENT DOCUMENTS

KR 1019960036770 10/1996
KR 101998060394 10/1998
KR 101999009289 2/1999
KR 1999-0065874 8/1999
KR 1020000027231 5/2000
KR 1020000027687 5/2000
KR 1020010010928 2/2001

OTHER PUBLICATIONS

KIPO Notice of Patent Grant dated Sep. 27, 2007 for the corresponding application KR 10-2006-0081265.
Byun, Kyung Jin, et al., "An Approach to the Decoder complexity Reduction in Waveform Interpolation Speech Coding", Jun. 2006, *11th International Conference Speech and Computer*, pp. 288-291.
Burnett, I.S., et al., "Low Complexity Decomposition and Coding of Prototype Waveforms", Sep. 1995, *1995 IEEE Speech Coding Workshop*, pp. 23-24.
Shoham, Yair, "Very Low Complexity Interpolative Speech Coding at 1.2 to 2.4 Kbps", Apr. 1997, *1997 IEEE International Conference on Acoustics, Speech, and Signal Processing*, pp. 1599-1602.

* cited by examiner

*Primary Examiner* — Talivaldis Ivars Smits
*Assistant Examiner* — Shaun Roberts
(74) *Attorney, Agent, or Firm* — Ladas & Parry LLP

(57) ABSTRACT

A waveform interpolation speech coding apparatus and method for reducing complexity thereof are disclosed. The waveform interpolation speech coding apparatus includes: a waveform interpolation encoding unit for receiving a speech signal, calculating parameters for a waveform interpolation from the received speech signal, and quantizing the calculating parameters; and a realignment parameter calculating unit for restoring a characteristic waveform (CW) using the quantized parameter, calculating a realignment parameter that maximizes a cross-correlation among consecutive CWs for the restored CW.

6 Claims, 3 Drawing Sheets

WAVEFORM INTERPOLATION SPEECH CODING APPARATUS AND METHOD FOR REDUCING COMPLEXITY THEREOF

FIELD OF THE INVENTION

The present invention relates to a waveform interpolation speech coding apparatus and method for reducing complexity thereof; and, more particularly, to a waveform interpolation speech coding apparatus and method, which previously calculates a realignment parameter in an encoder to allow a decoder not to calculate a realignment parameter maximizing cross-correlation among characteristics waveforms (CW) for reducing complexity thereof so as to improve the performance of a speech codec.

DESCRIPTION OF RELATED ARTS

Recently, various speech coding algorithms are used in a mobile communication systems or digital multimedia storing devices in order to transmit a speech signal using less bits while sustaining the speech quality thereof like as that before transmission.

A code excited linear prediction (CELP) algorithm is one of representative speech coding algorithms. The CELP algorithm is an effective coding method that sustains high speech quality at a low bit rate, for example, about 8 to 16 kbps. An algebraic CELP coding method among the CELP coding methods has been selected in international standards such as G.729, enhanced variable rate coding, and an adaptive multi-rate vocoder.

However, the CELP algorithm deteriorates the speech quality if the CELP algorithm is used at a low bit rate such as about 4 kbps. Therefore, the CELP algorithm is not used at a lower bit rate due to the speech quality deterioration.

In general, a waveform interpolation (WI) coding method is used for a low bit rate, for example, lower than 4 kbps. The WI coding is one of speech coding methods, which guarantees high speech quality at a bit rate lower than 4 kbps.

The WI coding method uses four parameters including a linear prediction (LP) parameter, a pitch period, the power of a characteristic waveform (CW), and a characteristic waveform, which are extracted from an input speech signal. Herein, the CW parameter is further divided into a slowly evolving waveform (SEW) and a rapidly evolving waveform (REW) parameter. Since the SEW parameter and REW parameter have different perceptual properties, for example, a periodic signal and a noise-like signal, they are quantized after separation in order to improve the coding efficiency.

Although the WI coding method can be advantageously used for a low bit rate such as about 4 kbps as described above, the WI coding method requires a mass amount of computation. Thus, the WI coding method cannot be applied into various application fields.

Meanwhile, the importance of factors influencing the performance of speech CODEC varies according to its application field. However, the complexity of speech CODEC is commonly considered as the high priority factor in various application fields in a view of usability and economical efficiency.

For example, since an encoder and a decoder are required to be operated at the same time for the real time communication, the complexity of speech CODEC is very important factor that decides whether it is possible to embody as a real time system or not. In the speech CODEC, the complexity of the encoder is more important than that of the decoder. Therefore, there are many researches in progress for reducing the complexity of the encoder in a coding apparatus in order to reduce the complexity of the speech CODEC.

In a technology field for storing data as another application field related to a speech signal, a speech coding algorithm is generally used for reducing the data amount of a speech signal. When a compressed speech signal is stored and reproduced later, the compressed speech data is decoded before reproducing. Therefore, the complexity of the encoder does not influence the performance of the speech CODEC because an encoder of speech CODEC is not required to be operated in real time for storing the technology field for storing the speech signal.

Hereinafter, a waveform interpolation encoder according to the related art will be described.

FIG. 1 is a block diagram illustrating a waveform interpolation encoder in accordance with the related art.

Referring to FIG. 1, the conventional waveform interpolation encoder includes a linear prediction coefficient (LPC) analyzer 10, an LPC to line spectral frequency (LSF) converter 11, a linear prediction analysis filter 12, a pitch estimator 13, a characteristic waveform (CW) extractor 14, a power calculator 15, a CW aligning unit 16, and a decomposition/down-sampler 17.

The conventional waveform interpolation encoder extracts parameters from a frame formed of 320 samples which are generated by sampling a speech signal at 16 KHz.

At first, the LPC analyzer 10 extracts LPC coefficients from an input speech signal by performing linear prediction (LP) analysis once per frame.

The LSF converter 11 performs quantization using various vector quantization methods after converting the extracted LPC coefficients to LSF coefficients in order to effectively quantize the extracted LPC coefficients from the LPC analyzer 10.

The LP analysis filter 12 receives a speech signal as input and the extracted LPC coefficients from the LPC analyzer 10, and calculates an LP residual signal for the input speech through an LP analysis filter formed of the LPC coefficients.

The pitch estimator 13 receives the LP residual signal from the LP analysis filter 12 and calculates a pitch period by performing pitch estimation. Various methods for estimating pitch period were introduced. However, in the present invention, a pitch estimation method using auto-correlation is used.

The CW extractor 14 receives the estimated pitch value from the pitch estimator 13 and the LP residual signal from the LP analysis filter 12, and extracts CWs having the calculated pitch period from the pitch estimator 13. The CWs are expressed using a Discrete Time Fourier Series (DTFS) like as following Eq. 1.

$$u(n,\phi) = \sum_{k=1}^{\lfloor P(n)/2 \rfloor} [A_k(n)\cos(k\phi) + B_k(n)\sin(k\phi)] \qquad \text{Eq. 1}$$

$$0 \le \phi(\bullet) < 2\pi$$

In Eq. 1, $u(n,\phi)$ denotes a characteristic waveform, $\phi = \phi(m) = 2\pi m/p(n)$, $A_k$ and $B_k$ denote DFTS coefficients, and $P(n)$ denotes a pitch value.

In general, the CWs are not matched each other in phase. In other words, the CWs are not aligned at a time axis.

Therefore, the CW aligning unit 16 performs a CW alignment operation that maximizes the smoothness of CW in a time axis direction. That is, the CW aligning unit 16 performs a circular time shift operation to align CWs in order to match a currently extracted CW to a previously extracted CW.

Since the CW can be considered as a wave form extracted from a periodic signal through converting the CW to DTFS, the circular time shift operation is equivalent to add the DTFS coefficients and a linear phase.

The power calculator 15 regulates the CW extracted from the CW extractor 14 as an own power. Then, the power calculator 15 performs a quantization operation. The quantization operation separates the CW shape and the power and quantizes them in order to improve the coding efficiency.

Meanwhile, if the CWs are aligned at a time axis, a two-dimensional surface is formed. The decomposition/down sampler 17 decomposes the two dimensional CW formed of two-dimensional surface into two independent elements, SEW and REW, through low pass filtering, and performs quantization on the SEW and the REW through down sampling.

The SEW parameter denotes a periodic signal which is voiced sound components and the REW parameter denotes noise-like signal which is unvoiced sound components. Since these parameters have different perceptual properties, the SEW and the REW are separated and quantized in order to improve the coding efficiency. In order to sustain the speech quality, the SEW parameter is quantized to have higher accuracy while sustaining a low bit rate, the REW parameter is quantized to have a high bit rate with lower accuracy, and the quantized SEW and REW parameters are transmitted.

In order to use such characteristics of CW, the SEW components are obtained from the CW by performing a low pass filtering on the two dimensional CW on the temporal axis, and the REW components are obtained from the CW by subtracting the SEW signal from the entire signal like as Eq. 2.

$$u_{REW}(n,\phi)=u_{CW}(n,\phi)-u_{SEW}(n,\phi) \quad \text{Eq. 2}$$

In Eq. 2, $u_{CW}(n,\phi)$ denotes the CW, $u_{SEW}(n,\phi)$ denotes the SEW component, and $u_{REW}(n,\phi)$ denotes the REW component.

Meanwhile, a WI decoder restores an original speech using a received LP coefficient, a pitch period, a power of CW, a SEW parameter, and a REW parameter. At first, the WI decoder interpolates consecutive SEW parameters and REW parameters, and adds them together, thereby restoring the original CW. The WI decoder performs a realignment operation after adding the power of the restored CW. The finally obtained two dimensional CW signal is converted to one dimension LP residual signal. Herein, it requires phase estimation using a pitch period according every each sample. The one dimensional residual signal is processed through an LP synthesis filter, thereby restoring it to the original speech signal.

Hereinafter, the CW alignment operation in the encoder will be described. As described above, the CW is extracted from the LP residual signal at a regular interval. The alignment operation is a process for maximizing the smoothness of CW in a time axis direction. It assumes than two consecutive CWs have a dimension shown in Eq. 3.

$$\lfloor P(n_i)/2 \rfloor=\lfloor P(n_i-1)/2 \rfloor=K \quad \text{Eq. 3}$$

In Eq. 3, $P(n_i)$ denotes a pitch, and K denotes the dimension of CW, that is, the number of harmonics. Then, the CW can be expressed as Eq. 4 or Eq. 5 before alignment.

$$u(n_{i-1},\phi)=\sum_{k=1}^{K}[a_k(n_{i-1})\cos(k\phi)+b_k(n_{i-1})\sin(k\phi)] \quad \text{Eq. 4}$$

$$u(n_i,\phi)=\sum_{k=1}^{K}[a_k(n_i)\cos(k\phi)+b_k(n_i)\sin(k\phi)] \quad \text{Eq. 5}$$

The CW alignment operation obtains an optimized phase shift value that maximizes cross-correlation of two consecutive CWs like as Eq. 6.

$$\phi_T=\underset{0\le\phi_\tau<2\pi}{\arg\max}[C(n_i,\phi_\tau)] \quad \text{Eq. 6}$$

The cross-correlation $C(n_i,\phi_\tau)$ can be expressed as Eq. 7.

$$C(n_i,\phi_\tau)=\sum_{k=1}^{K}\{[a_k(n_{i-1})a_k(n_i)+b_k(n_{i-1})b_k(n_i)]\cos(k\phi_\tau)+[b_k(n_{i-1})a_k(n_i)+b_k(n_i)a_k(n_{i-1})]\sin(k\phi_\tau)\}. \quad \text{Eq. 7}$$

In Eq. 7, $C(n_i,\phi_\tau)$ denotes the cross-correlation of two CWs.

Using the obtained realignment parameter (Phase Shift) $\phi_\tau$ in Eq. 7, $u(n_i,\phi)$ is aligned at $u(n_{i-1},\phi)$. In conclusion, the aligned characteristic waveform can be expressed as Eq. 8.

$$\hat{u}(n_i,\phi)=u(n_i,\phi-\phi_T) \quad \text{Eq. 8}$$

After extracting the CW and aligning the extracted CW, the power of CW is normalized. That is, a gain is separated from the CW in order to improve coding efficiency by reducing the variation of CW.

The decoder performs a CW realignment operation in order to restore consecutive CWs. That is, consecutive SEWs and REWs are added, a gain is multiplied to the sum thereof, and a de-normalization operation is performed on the multiplying result. If the encoder does not perform a parameter quantization operation, the decoder does not need to perform a realignment operation because the encoder already performs the CW alignment operation. That is, if the CW parameter is quantized, the CWs, aligned at the encoder, become misaligned due to quantization error.

The decoder performs the CW realignment operation that is identical to the CW alignment operation in order to realign the CW misaligned due to the quantization error. Such a CW realignment operation requires the mass amount of complicated computation in a technology field for storing a speech signal in which the complexity of the decoder is a major factor governing the performance of the decoder.

In order to reduce the complexity of the decoder in the present invention, the decoder does not perform an operation for calculating a realignment parameter. In order to allow the decoder not to perform the operation of calculating the realignment parameter, the encoder previously calculates a realignment parameter (phase shift), and transmits the calculated realignment parameter to the decoder.

Conventional waveform interpolation speech coding methods include a low bit rate waveform interpolation speech coding scheme, a less computation amount and low complexity waveform interpolation speech coding scheme, and a method of reducing the complexity of decomposition using a closed-loop prototype quantization scheme. Hereinafter, each of theses conventional methods will be described.

The conventional low bit rate waveform interpolation speech coding technology is a technology to reduce the computation amount of the waveform interpolation and decomposition operation that requires the mass complicated computation amount, and to reduce the computation amount of an LP parameter quantization operation.

In the conventional low bit rate waveform interpolation speech coding technology, the computation amount and the waveform interpolation and decomposition operation is reduced using a cubic spline method for obtaining consecutive waveform with small computation amount, and a pseudo cardinal spline method that can cancel a spline conversion operation. In order to reduce the computation amount, a speech signal is divided into a noise component and a periodic signal. The noise component is decomposed to unstructured components, and the periodic signal is decomposed to structured components, thereby embodying a low bit rate waveform interpolation CODEC in real-time.

The less computation amount and low complexity waveform interpolation coding technology expands spectrums to a fixed radix-2 size using a zero padding and IFFT method and reduces the computation amount by using cubic cardinal interpolation method. In this conventional technology, the decomposition operation is embodied with less computation amount by using a decomposition method that does not require high-level analysis.

The conventional method for reducing a computation amount of a decomposition operation using a closed-loop prototype quantization scheme is a technology of embodying a prototype waveform speech coder with less computation amount. In this method, a conventional prototype waveform encoder reduces the computation amount for decomposing a speech signal into SEW and REW using the closed-loop prototype quantization scheme. That is, the computation amount is reduced by not calculating accurate REW and SEW parameters.

As described above, these conventional technologies are a speech coding scheme that reduces the computation amount of an encoder in order to reduce the computation amount of all waveform interpolation coders. However, these conventional technologies cannot reduce the computation amount of a decoder embodied in real time when these conventional technologies are applied in the technology field of storing the speech signal. Therefore, these conventional technologies are not suitable to reduce the overall computation amount of entire application system in the technology field for storing a speech signal.

SUMMARY OF THE INVENTION

It is, therefore, an object of the present invention to provide a waveform interpolation speech coding apparatus and method, which previously calculates a realignment parameter in an encoder to allow a decoder not to calculate a realignment parameter maximizing cross-correlation among characteristic waveforms (CW) for reducing complexity thereof so as to improve the performance of the speech codec.

In accordance with an aspect of the present invention, there is provided a waveform interpolation coding apparatus for reducing a computation amount of a decoder including: a waveform interpolation encoding unit for receiving a speech signal, calculating parameters for a waveform interpolation from the received speech signal, and quantizing the calculating parameters; and a realignment parameter calculating unit for restoring a characteristic waveform (CW) using the quantized parameter, calculating a realignment parameter that maximizes a cross-correlation among consecutive CWs for the restored CW.

In accordance with an aspect of the present invention, there is also provided a waveform interpolation encoding method for reducing a computation amount in a decoder, including the steps of: a) receiving a speech signal, calculating parameters for waveform interpolation encoding, and quantizing the calculated parameters; b) restoring characteristic waveforms using the quantized parameters; and c) calculate a realignment parameter maximizing a cross-correlation among consecutive CWs for the restored CWs and quantizing the calculated realignment parameter.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a waveform interpolation speech coding apparatus and method will be described in more detail with reference to the accompanying drawings.

Figure 2:
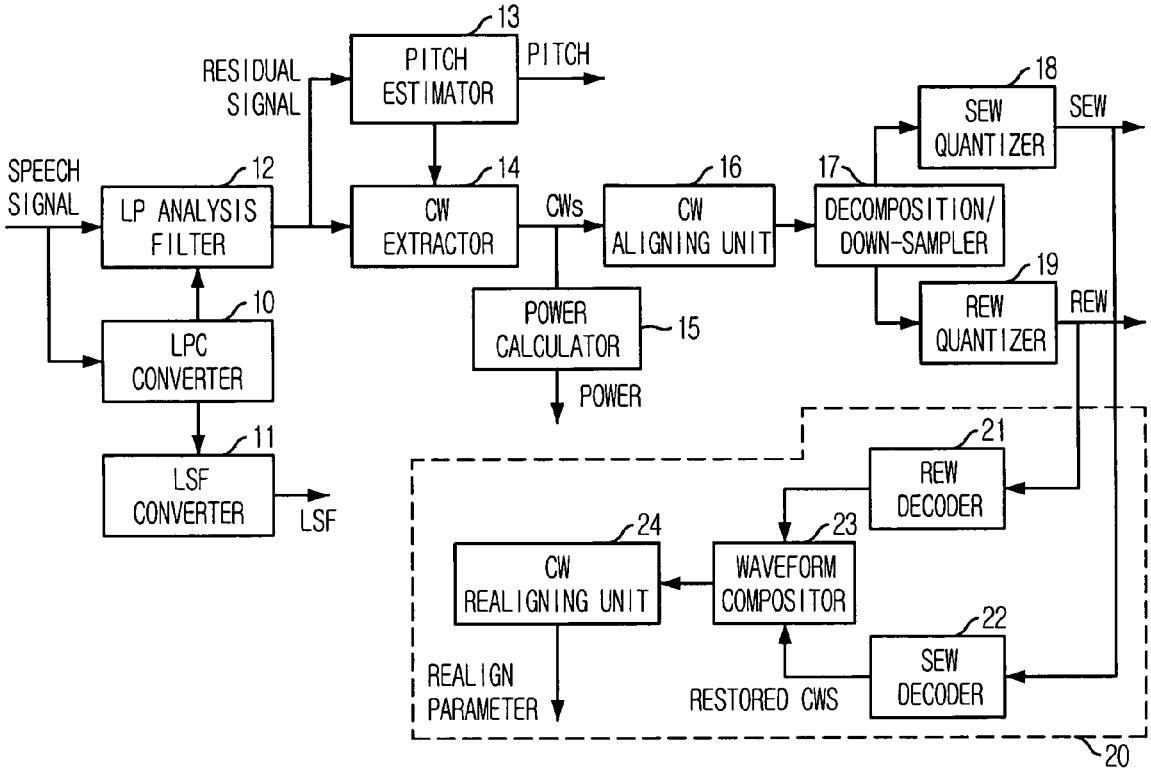
FIG. 2 is a block diagram illustrating a waveform interpolation encoder for reducing a computation amount of a decoder in accordance with an embodiment of the present invention.

FIG. 2 is a block diagram illustrating a waveform interpolation encoder for reducing a computation amount of a decoder in accordance with an embodiment of the present invention.

Referring to FIG. 2, the waveform interpolation encoder according to the present embodiment includes a linear prediction coefficient (LPC) analyzer 10, a line spectral frequency (LSF) converter 11, a linear prediction (LP) analysis filter 12, a pitch estimator 13, a characteristic waveform (CW) extractor 14, a power calculator 15, a CW aligning unit 16, a decomposition/down-sampler 17, a SEW quantizer 18, a REW quantizer 19, and a realignment parameter calculator 20.

The realignment parameter calculator 20 includes a REW decoder 21, a SEW decoder 22, a waveform compositor 23, and a CW realigning unit 24.

The realignment parameter calculator 20 is newly included in the encoder according to the present embodiment, and calculates a realignment parameter that is a phase shift, which is required to realign CWs in a decoder. The conventional WI encoder obtains an LPC, a pitch period, a power of CW, a SEW, and a REW in an encoding procedure. However, in the present embodiment, the encoder additionally calculates a realignment parameter through the realignment parameter calculator 20 as well as calculating the above five parameters.

At first, the waveform interpolation encoder according to an embodiment of the present invention receives a speech signal, calculates parameters for waveform interpolation, and quantizes the calculated parameters.

Then, the waveform interpolation encoder according to the present embodiment calculates a realignment parameter to be used in a decoder. Hereinafter, a step of calculating the realignment parameter will be described.

At first, the REW decoder 21 decodes the quantized REW parameter, and the SEW decoder 22 decodes the quantized SEW parameter.

Then, the waveform compositor 23 composites the SEW parameter and the REW parameter, thereby restoring an original CW.

Figure 1:
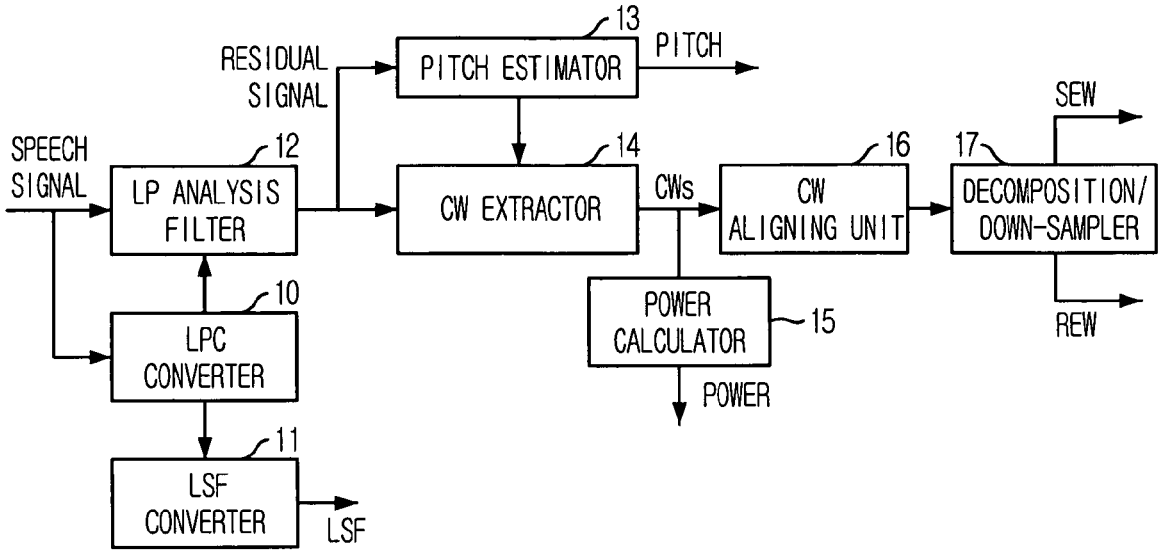
FIG. 1 (RELATED ART)
FIG. 1 is a block diagram illustrating a waveform interpolation encoder in accordance with a related art.

The CW restored in the waveform compositor 23 is not aligned due to a quantization error unlike the CWs outputted from the CW aligning unit 16 shown in FIG. 1. Therefore, the CW realigning unit 24 calculates a phase shift value for realigning the CWs like as the CW alignment operation shown in FIG. 1.

Accordingly, the waveform interpolation decoder receives the phase shift value for realignment from the encoder and performs a decoding operation without calculating a realignment parameter. In the encoder, the computation amount increases due to the additional operation for calculating the realignment parameter. In the technology field for storing the speech signal, the encoder is not required to process speech signals in real time. Therefore, although the computation amount of the encoder increases due to the realignment parameter calculation, it dose not influence the performance of the speech CODEC.

The realignment parameter obtained in the encoder is required to be quantized because it needs to be transmitted to the decoder for using it in the realignment operation. The influence of quantizing a realignment parameter to the realignment in a decoder can be measured using an average normalized cross-correlation like as Eq. 9.

$$ANCC = \frac{1}{N}\sum_{n_i|i=1}^{N}\left[\frac{C(n_i, \phi_T)}{C(n_i, \phi_T)}\right] \quad \text{Eq. 9}$$

In Eq. 9, $C(u_i,\phi_\tau)$ denotes a maximum cross-correlation value for alignment, and $C(u_i,\phi_{\tau'})$ denotes a maximum cross-correlation value for realignment.

If the decoder perfectly realigns the CW, the ANCC value becomes one. Table 1 shows ANCC values measured to show the effect of realignment parameters in a decoder. A short range in Table 1 denotes a phase shift range for realignment in a decoder.

TABLE 1

| The number of bits | Shift range | ANCC | Realignment rate |
|---|---|---|---|
| 0 | 0 | 0.94667 | 77.45% |
| 2 | $-2 \leqq T \leqq 2$ | 0.96216 | 91.22% |
| 3 | $-4 \leqq T \leqq 4$ | 0.97418 | 96.38% |
| 4 | $-8 \leqq T \leqq 8$ | 0.98722 | 98.56% |
| 5 | $-16 \leqq T \leqq 16$ | 0.99501 | 99.39% |
| 6 | $-32 \leqq T \leqq 32$ | 0.99906 | 99.89% |

In Table 1, when the shift range is 0, that is, when there is no realignment value to transmit in an encoder, the decoder does not perform a realignment operation. Although no alignment operation is performed, 77.45% of entire CWs are already aligned, and only 22.55% of CWs are misaligned due to the quantization error.

When the shift range is in 8, four bits are required to transmit a realignment parameter. If the realignment operation is performed using the realignment parameter, 98.56% of CWs are aligned. If a 25 msec frame length is used in a speed signal coding operation and five bits of realignment parameters are used, the rate of realignment is 99.39% compared with a real decoder, and the overall bit rate increases to about 0.2 kbps.

Figure 3:
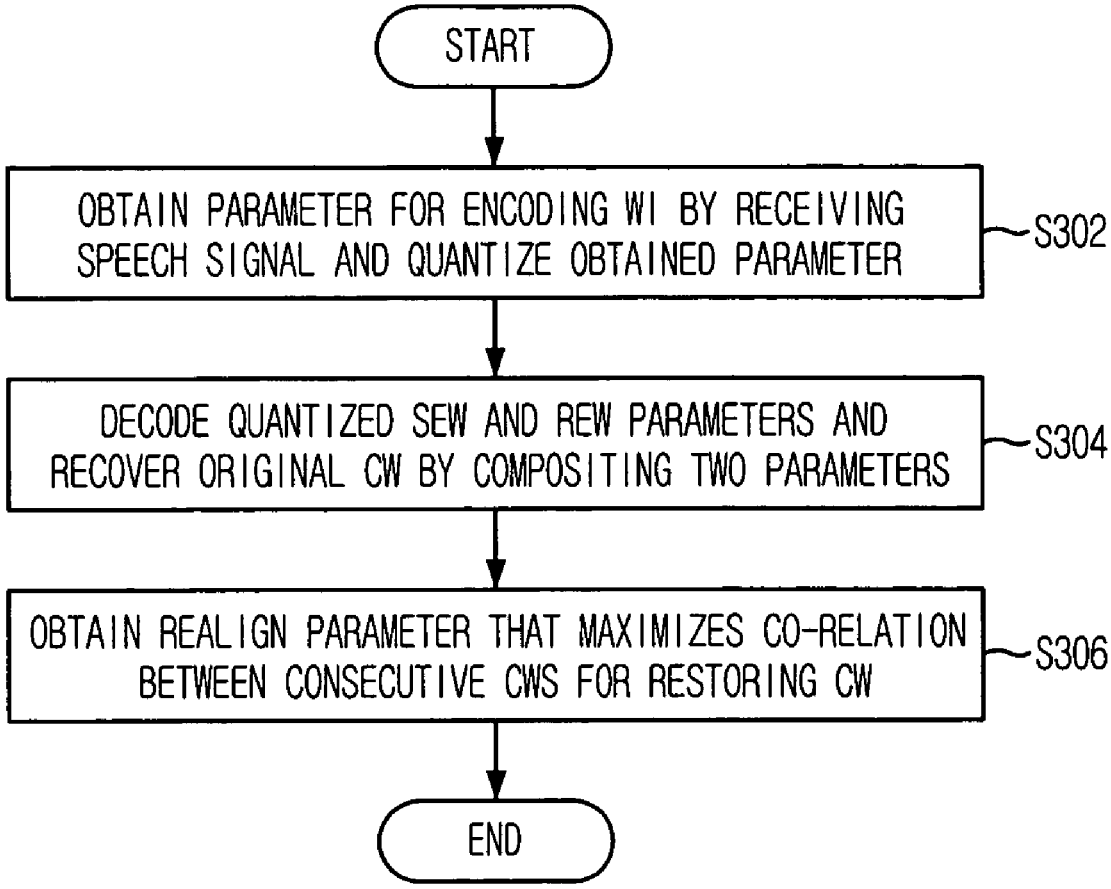
FIG. 3 is a flowchart of a waveform interpolation encoding method for reducing a computation amount of a decoder in accordance with an embodiment of the present invention.

FIG. 3 is a flowchart of a waveform interpolation encoding method for reducing a computation amount of a decoder in accordance with an embodiment of the present invention.

Referring to FIG. 3, an encoder according to the present embodiment receives a speech signal, and calculates parameters for waveform interpolation encoding using the received speech signal. These parameters are an LPC, a pitch period, the power of CW, a SEW, and a REW as shown in FIG. 2, and the calculated parameters are quantized at step S302.

Then, the quantized SEW and REW parameters are decoded, and the two parameters are composited, thereby restoring the original CWs at step S304.

The CW restored at the step S304 is not aligned due to quantization error unlike CWs outputted in the CW alignment step. Therefore, a realignment parameter is calculated for realigning the CWs like as the CW alignment, and the realignment parameter is quantized at step S306. Herein, the realignment parameter is a parameter for maximizing the cross-correlation among consecutive CWs.

The step S306 for calculating the realignment parameter occupies about 20% of entire computation amount in a decoder. Therefore, it is preferable to calculate the realignment parameter in the encoding procedure using a waveform interpolation encoder for reducing the computation amount of decoding.

The above described method according to the present invention can be embodied as a program and stored on a computer readable recording medium. The computer readable recording medium is any data storage device that can store data which can be thereafter read by the computer system. The computer readable recording medium includes a read-only memory (ROM), a random-access memory (RAM), a CD-ROM, a floppy disk, a hard disk and an optical magnetic disk.

According to the certain embodiments of the present invention, an encoder, which is not required real time operation, previously calculates a CW realignment parameter, quantizes the CW realignment parameter, and transmits the quantized CW realignment parameter to a decoder. The decoder uses the received CW realignment parameter for realigning the CWs without calculating the CW realignment parameter which requires a mass amount of complicated computation. Therefore, the computation amount of decoder can be reduced.

Although the bit rate would slightly increase due to transmission of the CW realignment parameter, the computation amount of the decoder can be reduced in the technology field of storing a speech signal in which the computation amount is a major factor influencing the performance thereof.

An encoder and a decoder must be operated in real time in the communication technology field. However, in the technology field of storing a speech signal, the encoder is not required to be operated in real time. Therefore, in the present invention, it allows an encoder to encode, compress and store the speech signal at off-line, and allows a decoder to restore the original speech signal through real time decoding according to needs, thereby reducing the computation among in the decoder that requires the real time decoding operation.

Since most test-to-speech (TTS) synthesizers developed recently are based on a technique known as synthesis by concatenation, the implementation of a high-quality TTS requires huge storage space for a large number of speech segments. In order to compress the database of TTS system, it is essential to use a speech CODEC. In a technology field related to compress the database of TTS synthesizer, the computation amount of a decoder seriously influences the performance of a speech codec.

The waveform interpolation encoding apparatus according to the present invention may be applied to the TTS compositor in order to reduce the complexity of the decoder, thereby decoding the database of the TTS compositor with less amount of computation after compressing and storing the database.

Such an effective speech coding method for a TTS compositor can be embedded in the TTS compositor.

The present application contains subject matter related to Korean patent application Nos. KR 2006-0055059 and KR 2006-81265 filed in the Korean Intellectual Property Office on Jun. 19, 2006, Aug. 25, 2006, respectively, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A waveform interpolation encoder for reducing a computation amount of a decoder, comprising:

a waveform interpolation encoding means for receiving a speech signal, calculating parameters for a waveform interpolation from the received speech signal, and quantizing the calculating parameters, and wherein the calculated parameters comprises at least a rapidly evolving waveform (REW) parameter and a slowly evolving waveform (SEW) parameter, which are each quantized after being separated out from the received speech signal; and a realignment parameter calculating means for restoring a first characteristic waveform (CW) using each of the quantized SEW parameter and the quantized REW parameter, calculating a realignment parameter that maximizes a cross-correlation among consecutive CWs for the restored CW, wherein the calculated realignment parameter is configured based on using each of the quantized SEW parameter and the quantized REW parameter, and wherein the calculated realignment parameter is configured to be used in a decoder for realigning a second CW based on the calculated parameters transmitted from the encoder.

2. The waveform interpolation encoder as recited in claim 1, wherein the realignment parameter calculating means includes:

a rapidly evolving waveform (REW) coding means for receiving the REW parameter among the quantized parameters and decoding the received REW parameter;

a slowly evolving waveform (SEW) coding means for receiving the SEW parameter among the quantized parameters and decoding the received SEW parameter;

a waveform combining means for combining the decoded REW parameter and the decoded SEW parameter in order to restore the CWs; and a CW realigning means for calculating a realignment parameter that maximizes a cross-correlation among consecutive CWs for the restored CW and quantizing the realignment parameter.

3. The waveform interpolation encoder as recited in claim 2, wherein the CW realigning means allocates a corresponding bit rate for transmitting the obtained realignment parameter to the decoder according to a rate of realigning the CWs.

4. A waveform interpolation encoding method in an encoder for reducing a computation amount in a decoder, comprising the steps of:

a) receiving a speech signal, calculating parameters for waveform interpolation encoding, and quantizing the calculated parameters, and wherein the calculated parameters comprises at least a rapidly evolving waveform (REW) parameter and a slowly evolving waveform (SEW) parameter, which are each quantized after being separated out from the received speech signal;

b) restoring a first characteristic waveform using the quantized SEW parameter and quantized REW parameter; and c) calculating a realignment parameter using each of the SEW parameter and the REW parameter for maximizing a cross-correlation among consecutive CWs for the restored CWs and quantizing the calculated realignment parameter, transmitting the quantized and calculated realignment parameter, and wherein the calculated realignment parameter is used in a decoder for realigning a second CW based on the quantized calculated parameters transmitted from the encoder.

5. The waveform interpolation encoding method as recited in claim 4, wherein the step b) includes the steps of:

b1) decoding the rapidly evolving waveform (REW) parameter among the quantized parameters;

b2) decoding the slowly evolving waveform (SEW) parameter among the quantized parameters; and b3) restoring a CW by combining the decoded REW parameter and the decoded SEW parameter.

6. The waveform interpolation encoding method as recited in claim 4, wherein in the step c), a bit rate for the transmitting of the calculated realignment parameter to the decoder is allocated according to a rate of realigning the CWs.

* * * * *